United States Patent [19]

Gloeckler

[11] 3,953,988

[45] May 4, 1976

[54] HAND KNITTING MACHINE FITTED WITH AN AUTOMATIC NEEDLE SELECTION DEVICE

[75] Inventor: Alfred Marcel Gloeckler, Mulhouse, France

[73] Assignee: Superba S.A., Mulhouse, France

[22] Filed: July 16, 1973

[21] Appl. No.: 379,305

[30] Foreign Application Priority Data

July 28, 1972 France ..... 72.27473

[52] U.S. Cl. ..... 66/75 A; 66/154 A

[51] Int. Cl.² ..... D04B 15/66; D04B 7/00

[58] Field of Search ..... 66/154 A, 78, 75, 75 A, 66/75 R

[56] References Cited

UNITED STATES PATENTS

| | | | |
|---|---|---|---|
| 3,035,426 | 5/1962 | MacQueen | 66/75 |
| 3,641,788 | 2/1972 | Mori et al. | 66/154 A |
| 3,748,873 | 7/1973 | Nakane et al. | 66/78 |
| 3,760,610 | 9/1973 | Hadam et al. | 66/154 A |
| 3,766,755 | 10/1973 | Hadam et al. | 66/154 A |
| 3,776,003 | 12/1973 | Krause | 66/75 |
| 3,783,642 | 1/1974 | Hadam et al. | 66/75 |
| 3,805,558 | 4/1974 | Pnotti | 66/154 A |
| 3,817,059 | 6/1974 | Krause | 66/154 A |

FOREIGN PATENTS OR APPLICATIONS

| | | | |
|---|---|---|---|
| 1,165,368 | 9/1969 | United Kingdom | 66/154 A |
| 1,560,974 | 9/1969 | Germany | 66/154 A |

*Primary Examiner*—Mervin Stein
*Assistant Examiner*—Andrew M. Falik
*Attorney, Agent, or Firm*—McNenny, Farrington, Pearne & Gordon

[57] ABSTRACT

A hand knitting machine having a single or double needle bed is provided with a device for selecting needles. This device includes an electromagnetic means located on a movable carriage which is electrically and mechanically connected to a program matrix by an endless metallic ribbon tensioned between two rollers over the width of the needle bed. The selected needles are controlled by an assembly of fixed and movable cams, the active and inactive positions of the latter being determined by a knob and lever assembly.

1 Claim, 11 Drawing Figures

HAND KNITTING MACHINE FITTED WITH AN AUTOMATIC NEEDLE SELECTION DEVICE

In the hand knitting machines known up to the present, the selection of needles to make jacquard, drawn thread and over thread patterns has been the subject of many devices. In the most common cases, a manual operation is involved which consists in individually selecting each needle for each row. To simplify this tedious operation which requires the continuous attention of the user, use is made of combs the teeth of which correspond to a multiple of the needles. It is thus possible to put only one needle of two or any other simple periodic combination of the same type in a working position.

More complex arrangements also make use of combs with regularly spaced slits and arranged so that each slit in a particular comb is alloted exclusively to one needle of a group, so that when the comb is made to take up an active position, this brings about the selection of a needle of the same order number in each group.

The selection of the needles in the foregoing devices is completely independent of the displacements of the carriage and is completed before a row is knitted.

Other devices use a film which records the selection data which are then memorized by mechanical means incorporated in the carriage in order subsequently to act on each needle when the carriage is displaced.

All these constructions, however, are incomplete in that the number of needles belonging to a group is limited by constructional considerations and the fact that the user can only produce patterns which have previously been recorded on a suitable support.

The object of the present invention is to provide a single or double section hand knitting machine and fitted with an automatic needle selection device, consisting of a pulse generator which is disclosed in U.S. Pat. application Ser. No. 493,081, filed July 30, 1974, which is a continuation of U.S. Pat. application Ser. No. 338,845, filed Mar. 7, 1973, a programming matrix enabling the selection data to be memorized while making a diagram of the pattern thus composed by the user as she pleases, a carriage characterized by selection units and cam components corresponding to them and an assembly of electro-mechanical connections linking the carriage to the generator.

The function of the pulse generator is to transmit consecutively the data on the matrix synchronously with the displacements of the carriage. Thus the selection unit which combines a solenoid and a permanent magnet must receive a control pulse at the precise moment when the relevant needle is opposite the solenoid. The emission of the pulses must therefore be delivered by the generator as the function of the displacements of the carriage. To do this, the carriage is connected to the generator by a mechanical connection constituted by an endless flexible metal strip, transforming the linear displacements of the carriage into a synchronous rotary movement, while at the same time ensuring that a continuous electrical contact is maintained to allow the selection pulses emitted by the generator to be transmitted to the solenoid.

Following the needle picking out operation effected by the selection units each needle is taken back up the cams which are fixed or positioned by pushers and control knobs which trace out the paths of the relevant needles to knit the stitches chosen by the user.

The attached drawings illustrate, by way of non-limitative example, an embodiment of the combination of devices which is the subject of the invention:

Figures 1, 2:
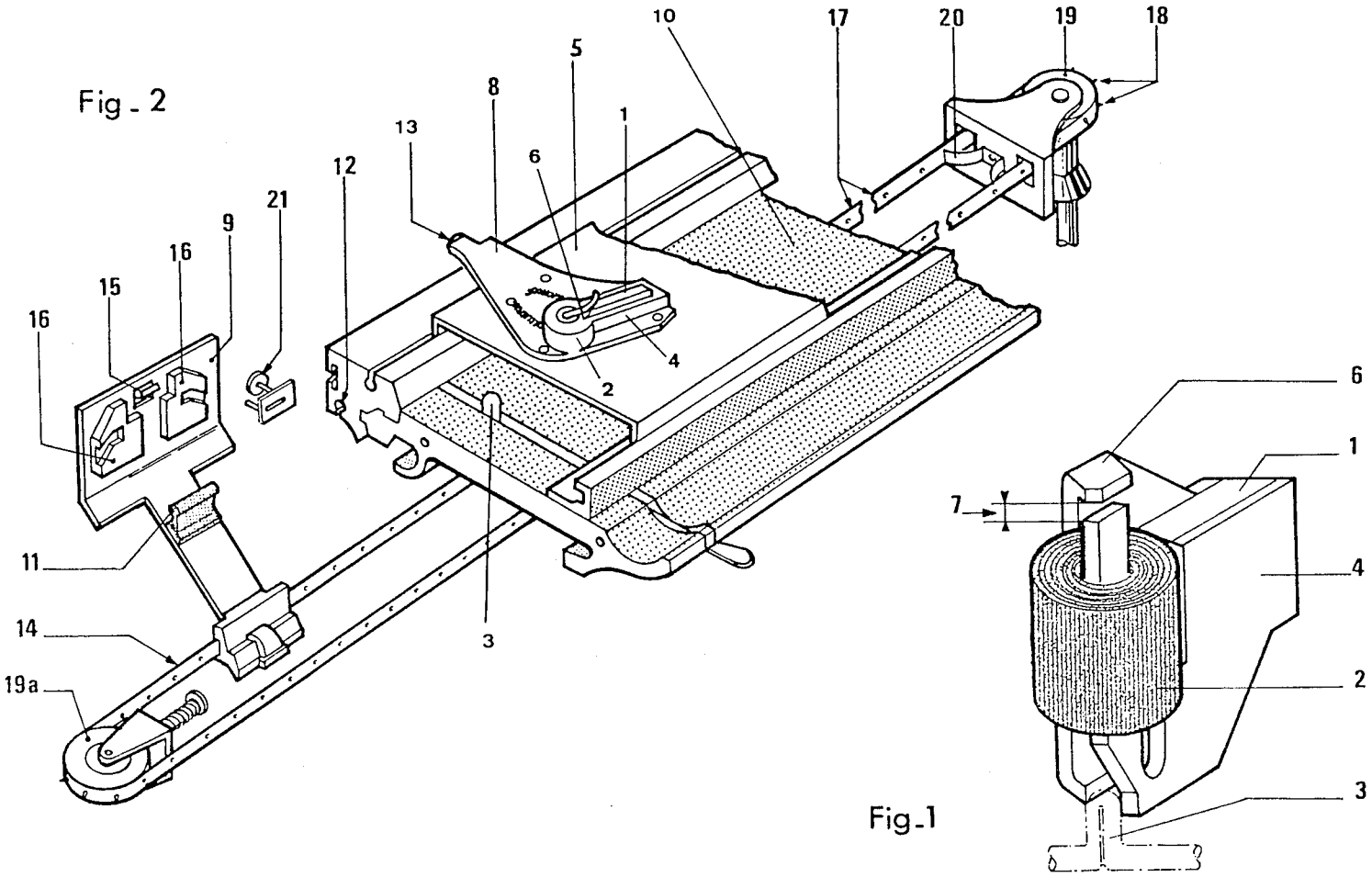
FIG. 1 shows an embodiment of the selection units.
FIG. 2 shows an embodiment of the electro-mechanical selection between the generator and the carriage.

The selection unit shown in FIG. 1 consists of a permanent magnet 1 combined with its polar components 4 and 6 and a solenoid 2, the core of which is integral with the polar component 4. A proper construction of the polar component 6 and the presence of an air-gap 7, adjustable if necessary, result in that when there is no electric current in the solenoid 2, the magnetic field is nil between the polar components 4 and 6 in the action area of the solenoid. Under these conditions, the heel 3 of the needle is not pulled by an attracting magnetic force. On the other hand, when an electric current passes, the solenoid causes the heel 3 to be attracted which is subsequently maintained by the force of attraction of the permanent magnet between the polar components 4 and 6 during the displacement of the carriage in order to pre-position the needle with a view to it being taken back by the appropriate cam.

The polar components 4 and 6, the permanent magnet 1 and the solenoid 2 are included in an insulating support 8 which positions the selection unit on the base plate 5 of the carriage. In addition, the particular form of the support 8 which is brought out in FIG. 2, makes it possible to make electrical and machanical connections between the selection unit and the pulse generator. To this end, an extremity of support 8 forms a projecting finger of the base plate 5 which engages between the drivers 16 of the cursor 9. The cursor guide 11 made of an insulating material, slides in the groove 12 of the section 10, driving the endless metal ribbon 14 with which it is integral.

Consequently, the carriage is constituted by the assembly 5, 8, 2, 4, 6, movable by the hand of the operator on the base plate 10 of the needle-bed with its cams which cause the upwards and downwards movement of the needles due to its to and fro displacement on the needle-bed.

Figure 11:
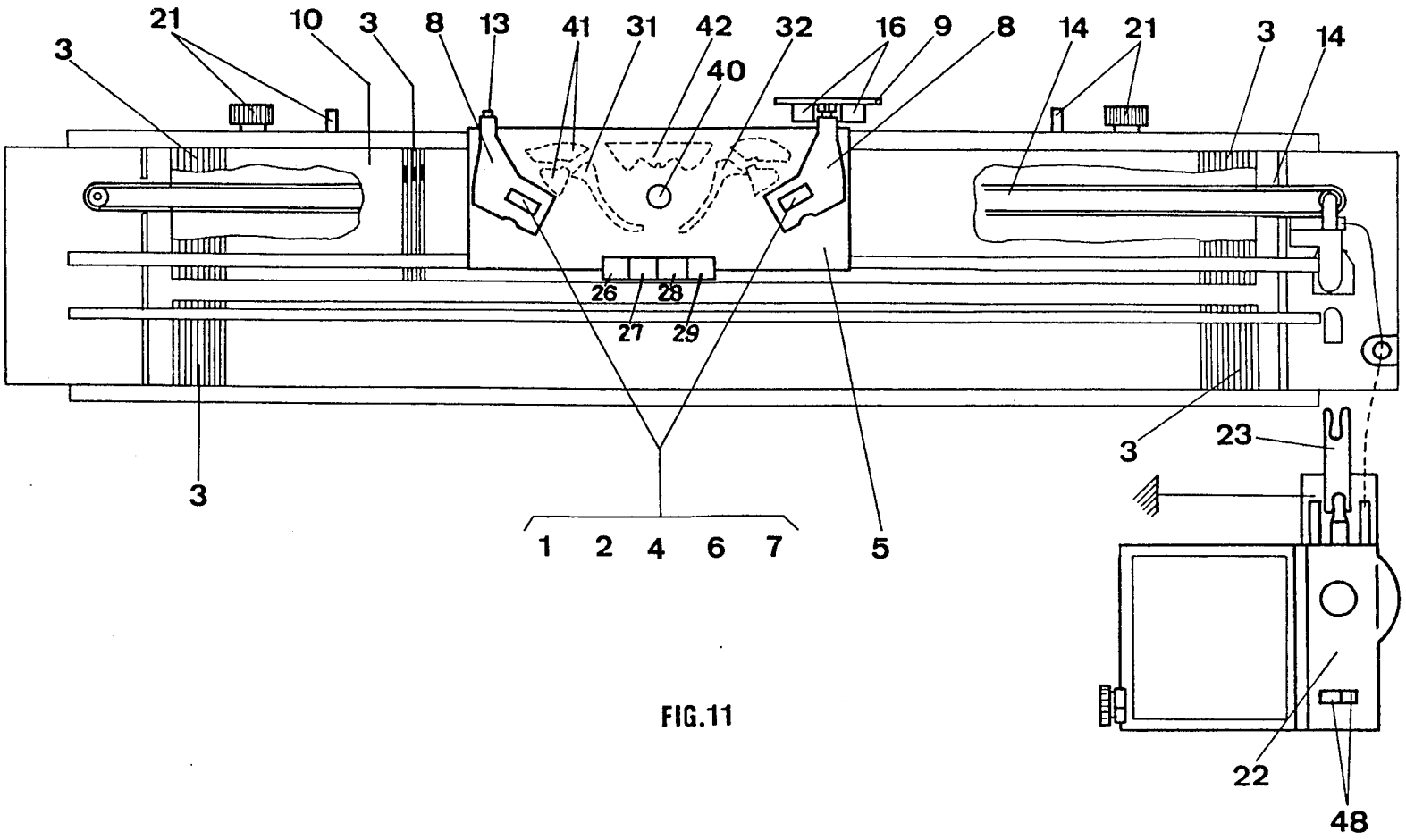
FIG. 11 shows the arrangement of the elements of FIGS. 1 to 4 on a rectilinear hand knitting machine, with the program matrix shown schematically in front elevation.

Concurrently, the electrical connection between the generator and the solenoid is made by the sliding contact 20, the metal strip 14, the flexible plate 15, located between the drivers 16 and the conducting component 13 seen on the face of the finger of the insulating support 8. In other words, the flexible plate 15 establishes an electrical connection with the contact stud 13 to electrically connect the contact stud 13 through the flexible plate 15 and cursor 9 to the ribbon 14. Since each carriage is fitted with two selection units (FIG. 11,) the generator must be switched to the unit characteristic of the displacement of the carriage. It is for this reason that, when the cursor 9 comes to a stop on the picker 21, the driver 16 retracts and frees the finger of the support 8. This is to say that when the picker 21 engages the oblique ramp on one of the drivers 16 it causes said driver to be moved downwardly and thereby frees said finger while simultaneously stopping the forward motion of the cursor 9. The carriage or base plate 5 continues to be moved by the operator and it is in this disengaged position that the knob 24 can be rotated to effect a design change. When the carriage is subsequently moved back in the opposite direction the finger 13 will pass over the lowered driver and engage the other of said drivers causing the cursor 9 and the conducting strip 14 to be carried along with the carriage to knit the next row. The generator is thus separated from the carriage until the selection unit acting on return of the carriage in turn engages between the drivers 16. In so far as the pickers 21 are positioned at the limit or beyond the limit of the area in which the needles are in a working position, the selection will be made from among all the needles. However, it is possible to include only a part of the needles placed in a working position between the pickers 21. The selection process will then involve exclusively only the preceding needles and the production of the pattern composed on the programming matrix will be limited to a part of each knitting row.

The metal ribbon 14 passes between two insulating pulleys 19 and 19*a*. The spindle of the pulley 19*a* is integral with a movable accessory which enables the tension of the ribbon to be adjusted. The pulley 19 is fitted with teeth 18 which cooperate with the perforations 17 of the metal ribbon 14 to effect position transmission without any sliding. The transmission shaft 23 in FIG. 3, which pilots the pulse generator lodged in the casing 22, is linked to the pulley 19 by a dismantable cardan.

The shaft 23 is driven by the ribbon 14 when the operator moves the carriage back and forth across the needle bed. The direction of rotation of the shaft 23 changes when the operator reverses the direction of movement of the carriage.

Figure 3:
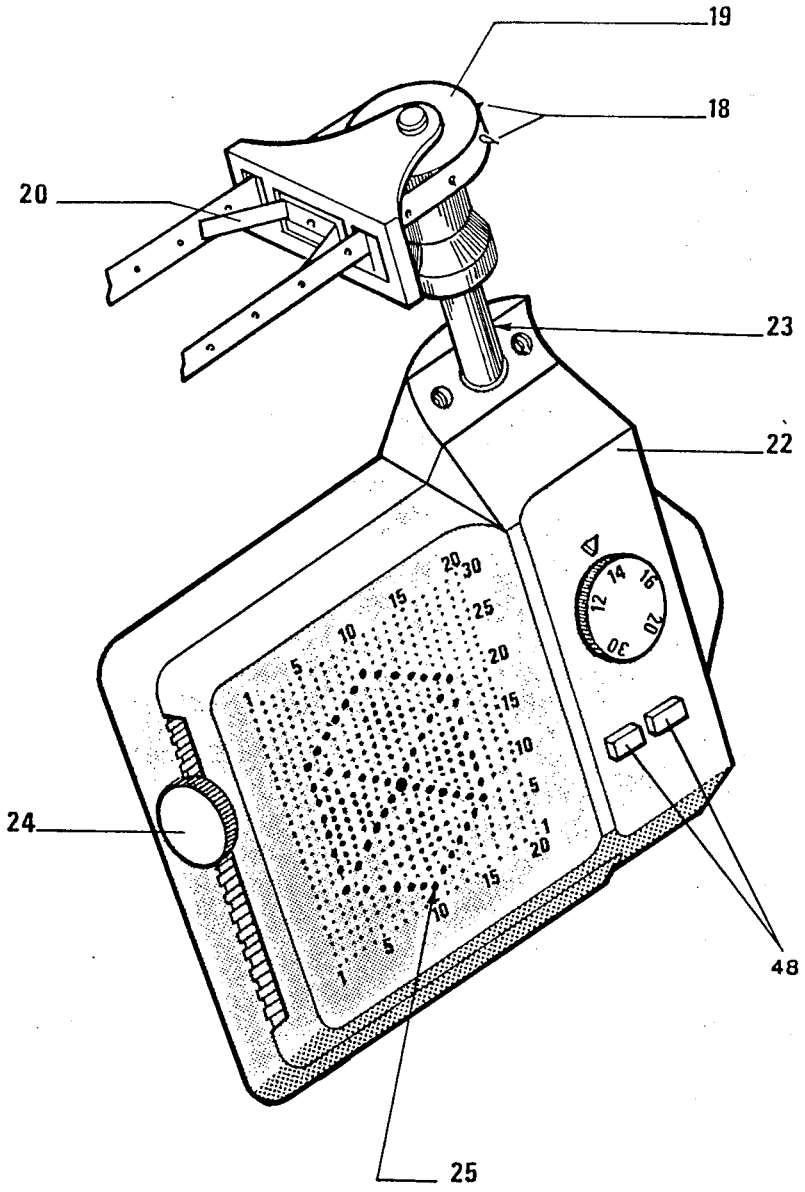
FIG. 3 shows the programming matrix containing the pulse generator.

As FIG. 3 shows, the casing 22 also serves as a support for the programming matrix which consists of twenty columns and thirty lines in the embodiment described by way of example. Each column is cyclically associated with a needle of a group in synchronous relationship with the displacements of the carriage. Each line is characteristic of a row of knitting and the transition from one line to the other occurs by displacing the index on the knurled knob 24 opposite the chosen line. The presence or absence of studs 25 at the intersection of a line and a column makes or breaks an electrical circuit as shown in the above referenced U.S. Pat. application Ser. No. 493,081, filed July 30, 1974 to actuate or deactuate the solenoid on the carriage. Concurrently, as can be seen in FIG. 3, the studs 25 define in diagrammatic form the pattern which is to be produced. In actual operation, the knob 24 is rotated to change the design to that on the next row after each traverse of the carriage. Thus, as shown in FIG. 3, if it is desired to produce the pattern shown on the matrix by the studs 25, the knob 24 is turned by one notch so as to move from the scanning of one line of matrix to the scanning of the following line of the matrix after each traverse of the carriage. If the operator elects to not turn the knob 24, the pattern indicated on the matrix at the location of the knob 24 will be repeated till the knob 24 is turned.

Figure 4:
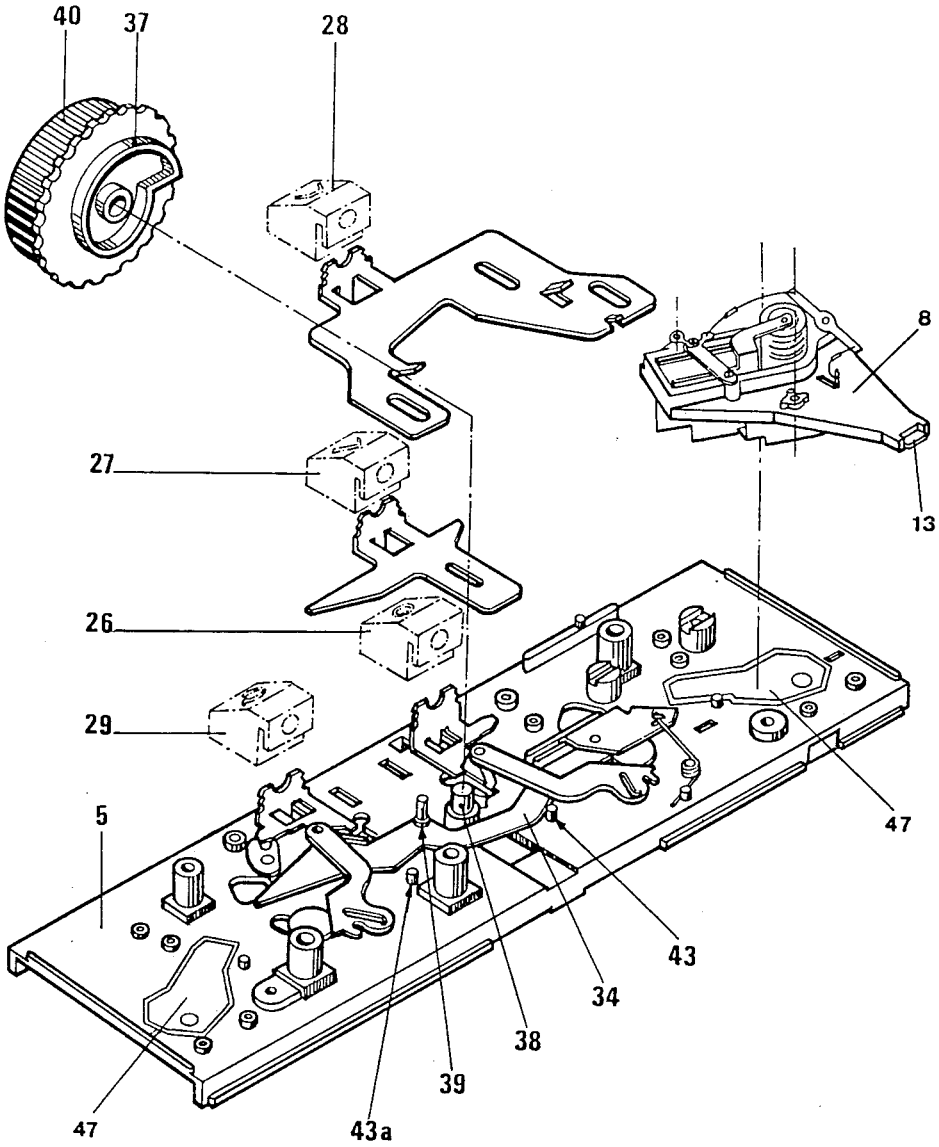
FIG. 4 is a top plan view of the carriage.

In the continuation of the description, the carriage is provided with pushers 26, 27, 28 and 29, and it is proposed to describe what happens when the pushers of the carriage are pushed (FIG. 4).

Figure 5:
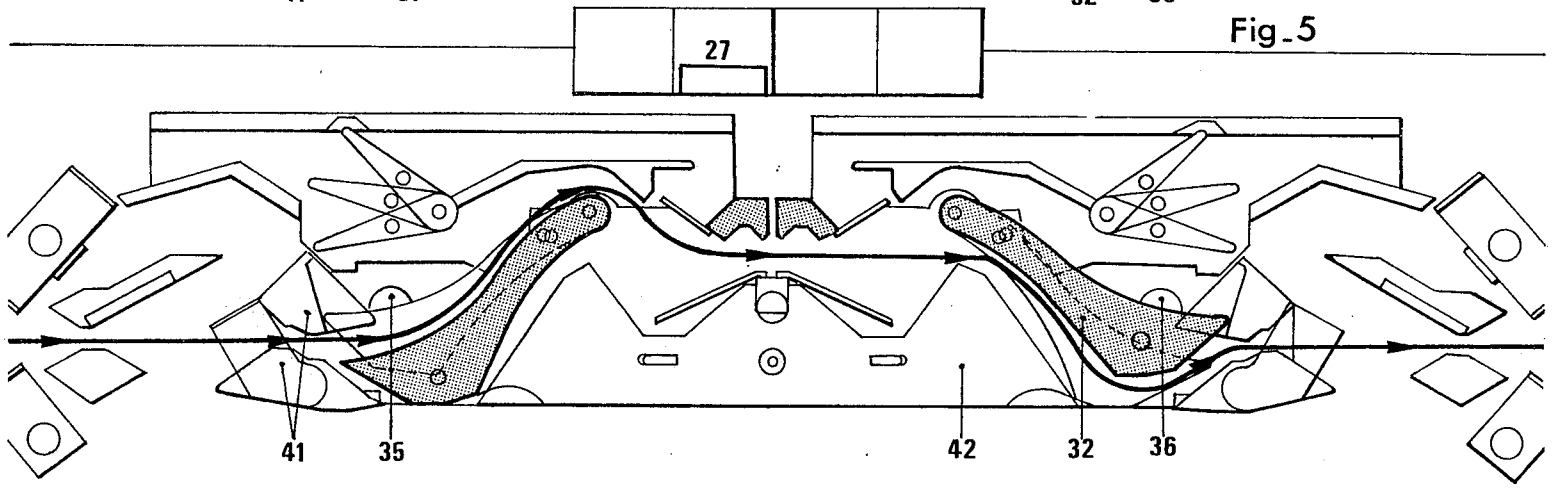
FIG. 5 is a bottom view showing the carriage positioned for jersey knitting.

The pusher 27 positions left hand and right hand movable cams 31 and 32 in abutment against the inner end of the slide pieces 35 and 36. The pusher 27 thus lowers the two movable cams 31 and 32, and when the pusher 27 is cancelled by actuation of the pushers 26, the two movable cams 31 and 32 are positioned upwards to enable the nonselected needle to pass beneath the cams 31 and 32. The carriage is also positioned for jersey knitting and follows the path represented in FIG. 5.

Each of the movable cams serves successively as a raising and lowering cam according to the direction in which the carriage moves. The movement of the cams 31 and 32 is regulated by the form of the slide pieces 35 and 36 and limited by the bar 34 (FIG. 4) the displacements of which toward the left progressively reduce the opening of the slide pieces 35 and 36. The bar 34 is integral with a pin 39 which bears on the cam 37 shaped into the shape of a spring. The rotation about its spindle 38 of the knob 40 rising above the cam 37 thus allows the length of the stitch to be regulated in accordance with the wool and the article to be knitted by limiting the downward movement of the needle when it proceeds along the path determined by the lower ramp of the cams 31 and 32.

Figure 6:
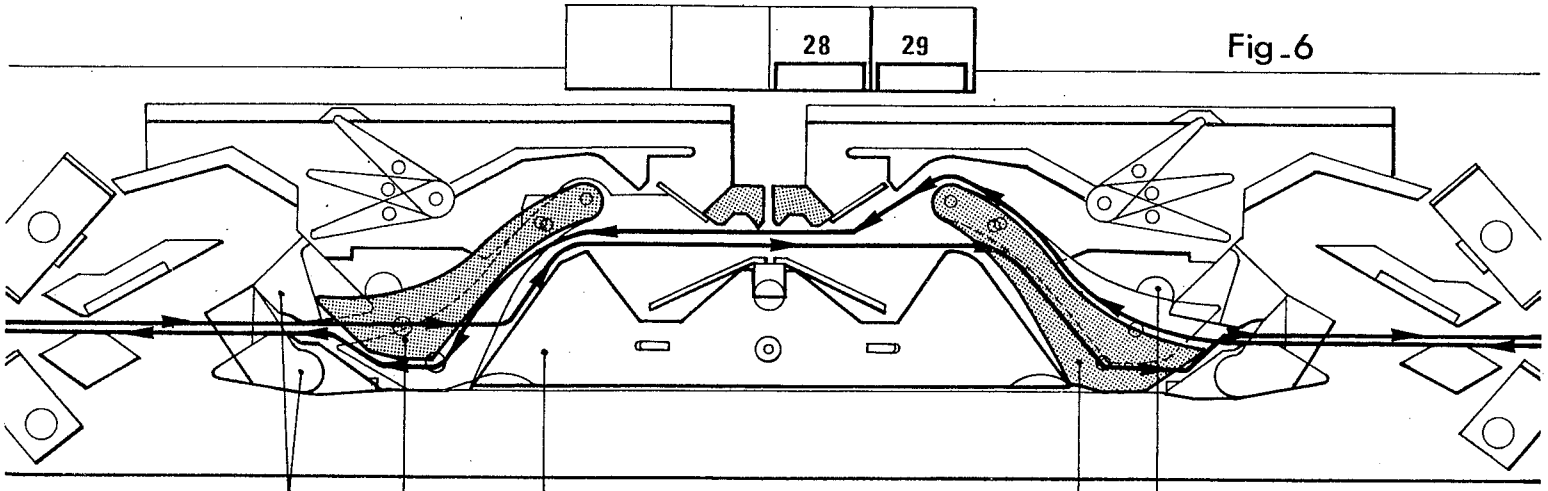
FIG. 6 is a bottom view showing the path followed by the needles for tuck in the hook knitting.

Simultaneous action on the pushers 28 and 29 traces the paths of the needle represented in FIG. 6 and enables rib, tuck in the hook and royal rib patterns to be knitted. The pusher 29 permits the cam 32 to move down in working position by means of a spring. The cam 32 thus abuts against the lower part of the slide piece 36 and positions the cam 31 in a manner such that the heel of the needle on emerging from the fixed cams 41 comes into contact with the lower part of the nose of the movable cam 31 which acts as a lowering cam. The plate 42, which is integral with the pins 43 and 43*a* (FIG. 4) is brought to the same level as the cams 31 and 32 by the action of the pusher 28 and limits the amplitude of the needle to insure that the thread is gripped without however forming a stitch.

Figure 7:
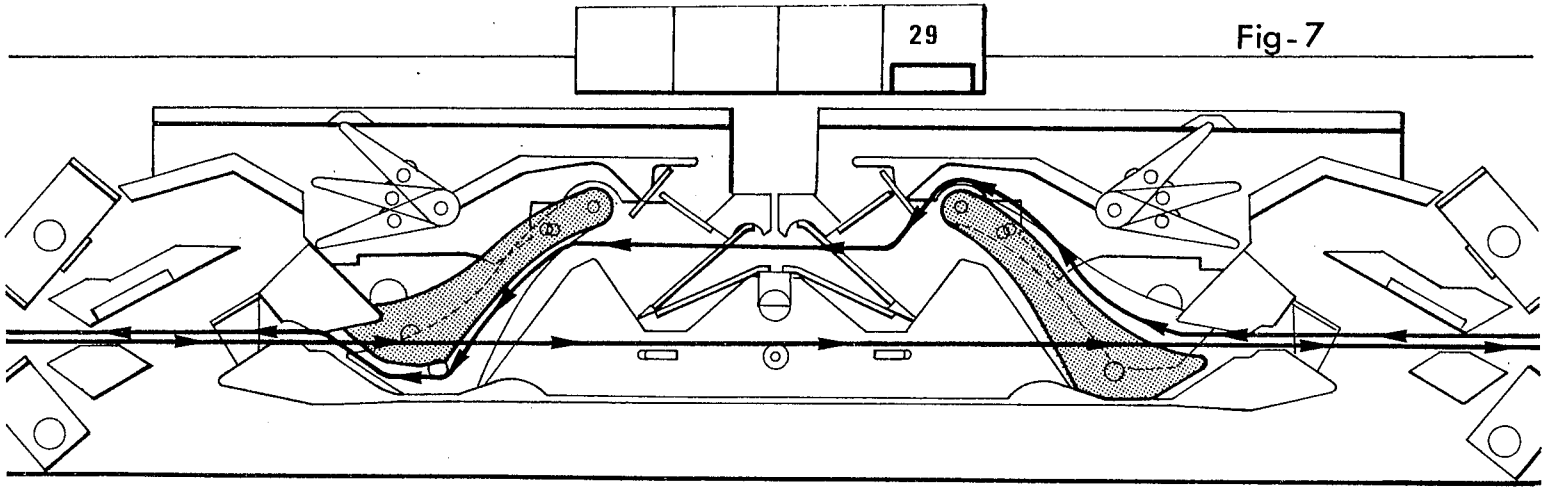
FIG. 7 is a bottom view showing the path followed for circular knitting.

FIG. 7 shows the path followed by putting the pusher 29 into action which allows circular knitting in correlation with an identical carriage moving on the front section.

Figure 8:
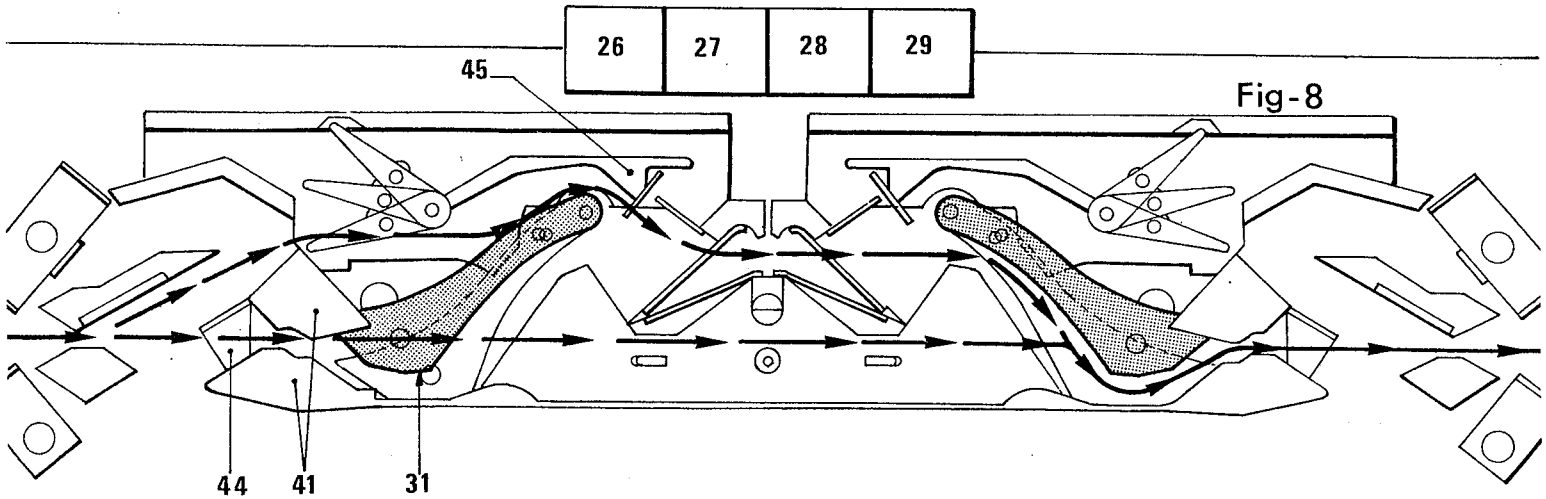
FIG. 8 is a bottom view showing the path followed for jacquard knitting.

It is now proposed to describe the paths followed by the needles previously picked out by the left and right hand selection units in combination with the pulse generator and the programming matrix. To produce jacquard and slip stitches, the pushers 26, 27, 28 and 29 are in their rest position. As FIG. 8 shows, the needles picked out by the selection unit corresponding to the displacement direction of the carriage are taken by the deviation spring 44 and the upper fixed cam 41 to abut on the end of the movable cam 31 which co-operates with the high cam 45 to bring back the needles into the action area of the right hand movable cam 32 where they rejoin the nonselected needles.

It is clear that it is only the needles that have been picked out that have actually knitted and the stitches obtained correspond to the plugs on the programming matrix. An electronic invertor included in the pulse generator then allows the carriage to select an additional combination of needles and thus knit with yarn of a different color when the carriage has returned. The invertor operates by providing an electrical signal or by providing no signal for any given location on the program matrix, depending upon which one of the two knobs or switches 48 is pushed. Thus, if one of the knobs 48 is pushed an electrical signal is produced when one of the studs 25 is encountered. When the other of the knobs 48 is pushed, an electrical signal is not produced when the stud 25 is encountered, but instead an electrical signal is produced when a location on the program matrix is reached which does not have a stud.

Figure 9:
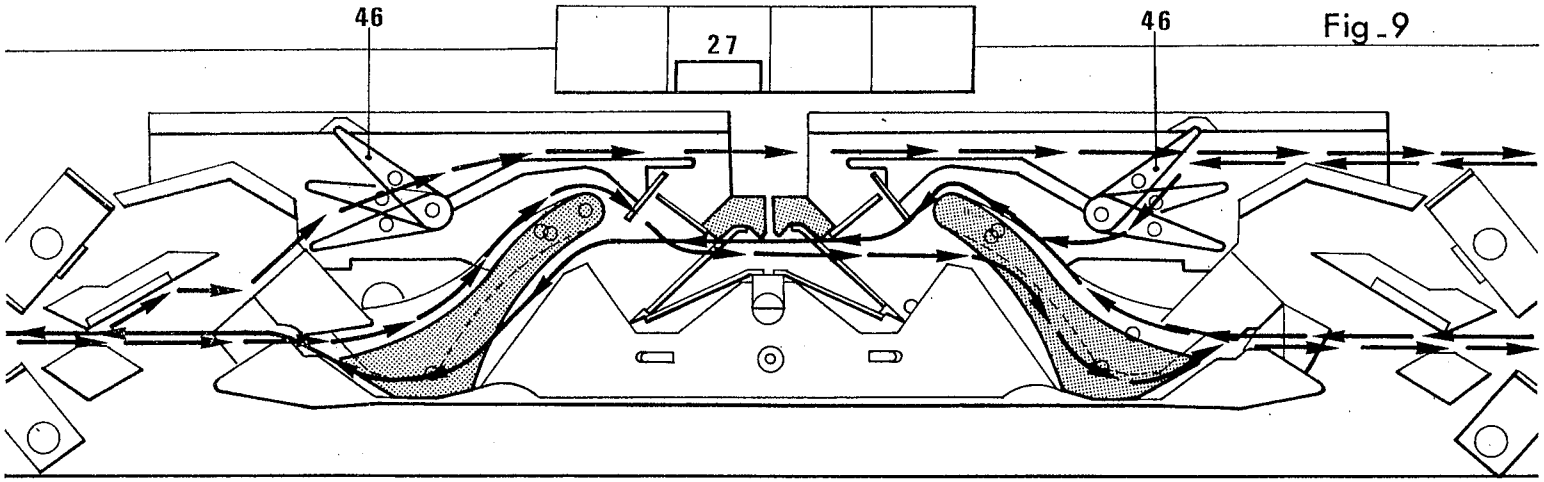
FIG. 9 is a bottom view showing the path followed for placing the needles in the waiting position.

As FIG. 9 shows, the carriage used within the scope of the invention enables tuck knitting to be carried out. Thus the needles that have not been picked out by the selection units carry out a jersey knitting operation, since the carriage is positioned by the pusher, whereas the previously selected needles are pushed into the waiting position up to their maximum height by the recall cams 46. It is only when the recall cams are directed upward that the needles in the waiting position (i.e., the upper position of the needle which while keeping its stitch during several strokes of the carriage can be brought back into working position by actuating the cam 46) are brought down toward the relevant movable cam 32 in order to knit in their turn. The cams 46 are operated by the buttons on the top of the carriage, and each cam 46 carries only one finger which can be positioned in the three different ways shown in the drawings.

Figure 10:
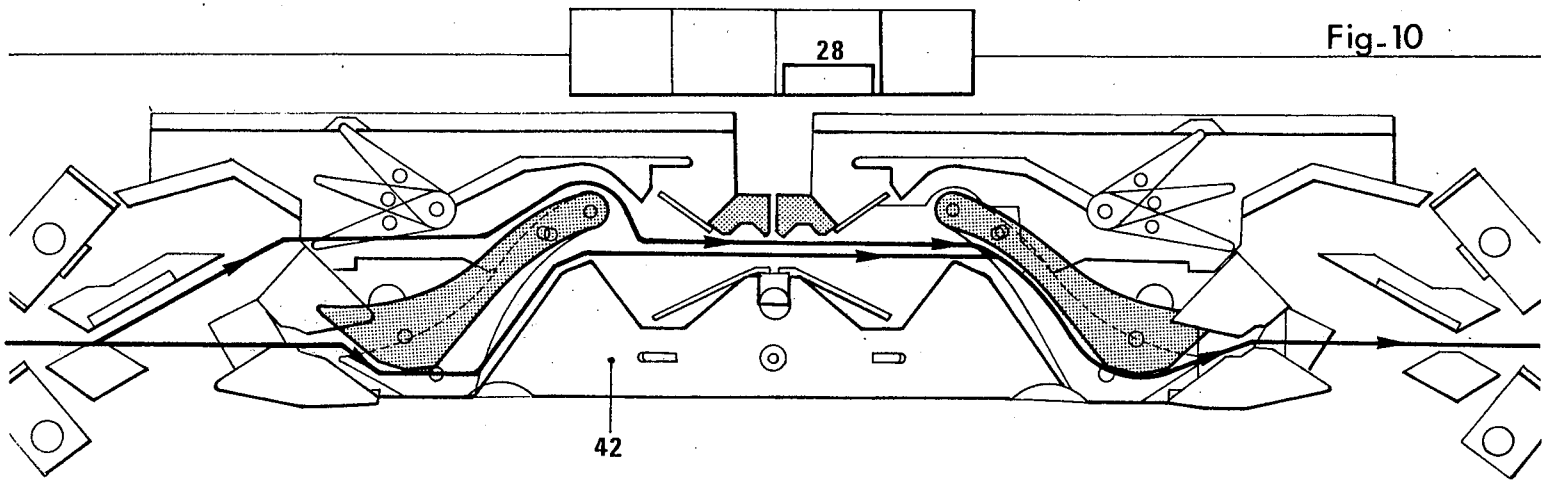
FIG. 10 is a bottom view showing the path for the needles for over thread knitting.

FIG. 10 shows that the utilization of the tuck plate 42 controlled by the pusher 28, combined with the selection units, enables overthread stitches to be made in accordance with the programme selected on the programming matrix. Thus the needles that have not been selected are pushed by the tuck plate in a way such that the thread is caught by the hook of the needle, without however, making a stitch.

What I claim is:

1. In a knitting machine comprising a needle-bed and a needle selecting device; said needle selecting device including a carriage movable in relation to the needle-bed, movable electro-magnetic means fitted on said carriage for movement therewith, a stationary program matrix having a predetermined number of columns and lines and further having electrical means producing an electrical signal according to the presence of studs on said matrix, said movable electro-magnetic means being constructed and arranged to select a needle of said needle-bed in accordance with an electrical signal received from said stationary program matrix, an assembly of fixed and movable cams constructed and arranged to drive said selected needle in order to achieve various types of knitting, wherein the improvement comprises an electro-mechanical interconnecting means constructed and arranged to electrically and mechanically interconnect said stationary program matrix and said movable electro-magnetic means; said electro-mechanical interconnecting means including a metallic electrically conductive endless ribbon tensioned between two rollers over the width of the needle-bed, one of said rollers being electrically and mechanically connected to said program matrix, a cursor fitted on said endless ribbon, electrical contact means on the carriage connected to the electro-magnetic means, electrical contact means on the cursor connected to the endless ribbon and cooperating with the contact means of the carriage for carrying the electrical signal to the electro-magnetic means, and mechanical locking means locking the cursor on the carriage for driving said cursor and said endless ribbon when the carriage is travelling.

* * * * *

UNITED STATES PATENT AND TRADEMARK OFFICE

CERTIFICATE OF CORRECTION

PATENT NO. : 3,953,988
DATED : May 4, 1976
INVENTOR(S) : Alfred M. Gloeckler

It is certified that error appears in the above-identified patent and that said Letters Patent are hereby corrected as shown below:

Column 1, line 65, "up" should read --by--.

Column 3, line 38, "position" should read --positive--.

Column 4, line 12, this sentence was omitted and should be inserted, '' The pusher 26 serves to cancel all of the other pushers--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*